US006227916B1

(12) United States Patent
Wu

(10) Patent No.: US 6,227,916 B1
(45) Date of Patent: May 8, 2001

(54) EASILY ASSEMBLED ELECTRICAL CONNECTOR

(75) Inventor: Miguel Wu, Taoyuan (TW)

(73) Assignee: Exito Electronic Co., Ltd., Taoyuan (TW)

( * ) Notice: Subject to any disclaimer, the term of this patent is extended or adjusted under 35 U.S.C. 154(b) by 0 days.

(21) Appl. No.: 09/350,113

(22) Filed: Jul. 9, 1999

(51) Int. Cl.[7] ..... H01R 11/22
(52) U.S. Cl. ..... 439/857; 439/606
(58) Field of Search ..... 439/106, 606, 439/686, 695, 857, 685, 682

(56) References Cited

U.S. PATENT DOCUMENTS 3,104,925 * 9/1963 MacNamara ..... 439/857
3,248,686 * 4/1966 Ruehlemann ..... 439/857
3,654,544 * 4/1972 Sitzler ..... 439/857
5,647,751 * 7/1997 Shulman et al. ..... 439/857
5,888,105 * 3/1999 Brown et al. ..... 439/857
5,957,734 * 9/1999 Gladd et al. ..... 439/857

* cited by examiner

*Primary Examiner*—Hien Vu
(74) *Attorney, Agent, or Firm*—Bacon & Thomas, PLLC

(57) ABSTRACT

A novel electrical connector structure is disclosed. The electrical connector includes a socket portion for receiving therein an electrical plug, a conductive terminal for clamping a metal pin of the electrical plug in the socket portion, and a wrapping portion for securing and protecting the conductive terminal in the socket portion. By designing the shape of the conductive terminal to be relatively narrow in front and relatively wide in rear, and modifying the opening shape of the socket portion accordingly, the conductive terminal can be smoothly inserted into the socket portion so as to allow the electrical connector to be easily assembled. Furthermore, the socket portion can be integrally formed because the conductive terminal is combined with the socket portion by direct insertion operation rather than conventional placing and covering operations.

17 Claims, 9 Drawing Sheets

EASILY ASSEMBLED ELECTRICAL CONNECTOR

FIELD OF THE INVENTION

The present invention is related to an electrical connector having an easily assembled structure, and more particular to an easily assembled receptacle adapted to be used outdoors.

BACKGROUND OF THE INVENTION

Please refer to FIG. 1 which schematically shows the appearance of a receptacle, which is suitable to be used outdoors, for example, to extend power supply due to the material property thereof. As shown, the socket 101 of the receptacle 10 is provided for inserting and fitting therein a power plug 11. By the electric contact of the metal pins 111, 112 and 113 of the power plug 11 with the conductive terminals (not shown) in the socket 101, power can be extensively supplied to a distant electrical appliance, especially an outdoor appliance. For an outdoor receptacle, a thermally stable physical property is required because the surrounding temperature that the receptacle is subject to may vary from day to day up to tens of degrees. A material conventionally used for making a general receptacle is polyvinyl chloride (PVC). PVC, however, is not a good material for an outdoor receptacle due to its relatively high temperature sensitivity in volume, i.e. relatively significant expansion/shrinkage effect with temperature. The significant change in socket volume is likely to obstruct the plugging/unplugging operation of the power plug or cause poor contact between the power plug and the receptacle. Therefore, composite materials and a specific assembling manner have been used to produce an outdoor receptacle.

The composite receptacle includes an inner body and a wrapping portion The inner body is made of an insulating material of relatively low temperature sensitivity, for example a kind of engineering plastic such as polycarbonate, and then partially sealed by the wrapping portion made of a general insulating material such as PVC, leaving the socket face exposed. By this way, even in a chilly climate down to −20° C., the connector can still work well.

For a conventional composite receptacle, the inner body consists of a socket portion and a conductive terminal portion. The conductive terminal portion is located in the socket portion for clamping metal pins of a plug therebetween when the plug is inserted into the socket portion. As shown in FIG. 2 which schematically shows the conductive terminal portion of a conventional composite receptacle, the conductive terminal portion 21 generally includes two sets of elastic metal pieces 211 and 212 for clamping therebetween two metal pins of the plug, respectively, and one conductive sleeve 213 for optionally receiving therein a ground pin of the plug. In order to guide the metal pins of the plug into the passages 214 of the two sets of metal pieces 211 and 212 smoothly, the front end of each metal piece is properly bent to make the opening 215 of each of the passages 214 have a funnel shape.

Unfortunately, owing to the relatively large passage opening, the positioning of the conductive terminal portion into the socket portion is difficult so that the socket portion of the conventional inner body has to be divided as two parts, i.e. a seat part for receiving the metal pieces and a cover part for securing the metal pieces in the seat part, as shown in FIG. 3 which schematically shows the socket portion of the conventional composite receptacle having the conductive terminal portion of FIG. 2.

As shown, the two sets of metal pieces 211 and 212 and the conductive sleeve 213 of the conductive terminal portion are placed downwards into two side trenches 311 and 312 and a top trench 313 of the seat part 31 from the top of the trenches, respectively, with the bent front ends of the metal pieces protruding from the front surface of the seat part 31. After the conductive terminal portion is settled in the seat part, the cover part 32 is combined with the seat part 31 having positioned therein the conductive terminal portion by inserting the seat part 31 into the cover part 32 from the rear surface of the cover part 32 to form the inner body. Afterwards, the insulating material such as PVC, as mentioned above, is injection molded onto the assembled inner body to form the wrapping portion. By this way, the outdoor receptacle can be obtained.

From the above description, it is understood that the assembling process of the conventional outdoor receptacle is relatively complicated and the manufacturing cost is relatively high owing to the division of the socket portion as two separate parts. By the way, it is also a problem that the manufacturing accuracy should be highly required in order to perfectly combine the two separate parts.

SUMMARY OF THE INVENTION

An object of the present invention is to provide an electrical connector such as a receptacle adapted to be used outdoors and having an easily assembled structure.

According to the present invention, an electrical connector for receiving therein an electrical plug to make an electric connection includes a socket portion made of a first insulating material, and having a first through hole penetrating therethrough, wherein a first and a second openings of the first through hole are located on a first and a second surfaces of the socket portion, respectively, and a shape of the first opening matches a shape of a metal pin of the electrical plug to allow the metal pin to be inserted therefrom; a first conductive terminal consisting of a first base and two first elastic conductive pieces and inserted into the first through hole from the second opening for clamping the metal pin inserted from the first opening in a passage between the two first elastic conductive pieces, wherein the two first elastic conductive pieces are parallelly connected to the first base and have a total width narrower than a width of the first base so that the first base fills the second opening after the two first elastic conductive pieces enter the first through hole; and a wrapping portion made of a second insulating material and applied onto the socket portion for securing and protecting the first conductive terminal in the socket portion.

In a preferred embodiment, the first and the second openings are two slots perpendicular to each other, and the metal pin and the first conductive terminal are two flat metal plates inserted from the first and the second openings, respectively, and cross each other in the first through hole.

In order to assure of a remained vacancy between the first elastic conductive pieces and walls of the first through hole after the first elastic conductive pieces enter the first through hole, the first base preferably has a shoulder structure protruding from sides of the first elastic conductive pieces so as to have a width larger than a total width of the first elastic conductive pieces. The presence of the remained vacancy provides a stretching space for the conductive pieces if a thermally expansion effect occurs.

Preferably, a stopper structure is arranged in the first through hole to sustain against the shoulder structure of the first conductive terminal in order to prevent the first base from entirely entering the first through hole, and thus assure that the first base can fill the second opening.

In accordance with another aspect of the present invention, the socket portion further includes a second through hole penetrating therethrough, wherein a third and a fourth openings of the second through hole are located on the first and the second surfaces of the socket portion, respectively, and a shape of the third opening matches a shape of another metal pin of the electrical plug to allow the another metal pin to be inserted therefrom. In this case, the electrical connector further includes a second conductive terminal consisting of a second base and two second elastic conductive pieces and inserted into the second through hole from the fourth opening for clamping the another metal pin inserted from the third opening in a passage between the second two elastic conductive pieces, wherein the second two elastic conductive pieces are parallelly connected to the second base and have a total width narrower than a width of the second base so that the second base fills the fourth opening after the two second elastic conductive pieces enter the second through hole.

For a general electrical plug, the metal pins thereof are of the same shape, so in this case, the second conductive terminal also have a shape substantially the same as that of the first conductive terminal.

In another preferred embodiment, the first and the second openings are two slots perpendicular to each other, and the third and the fourth openings are another two slots perpendicular to each other.

For allowing to be inserted therein an electrical plug having a ground pin, the socket portion further includes a third through hole penetrating therethrough. The ground pin is in electric contact with a third conductive terminal in the third through hole, and the third through hole has an opening shape on the first surface of the socket portion matching a shape of the ground pin to allow the ground pin to be inserted therefrom.

Preferably, a front end of the passage between the two first elastic conductive pieces is of a funnel shape for guiding the metal pin into the passage smoothly.

Preferably, the wrapping portion is applied onto the socket portion by injection molding the second insulating material onto the socket portion with the conductive terminal(s).

In order to be used outdoors, the first insulating material preferably has a low temperature sensitivity, and generally lower than the second insulating material. The first insulating material can be an engineering plastic such as an Acrylic-Butadiene-Styrene (ABS), polycarbonate, nylon-glass fiber composite, polyethylene (PE) or polypropylene (PP). On the other hand, the second insulating material can be polyvinyl chloride (PVC).

Preferably, the socket portion is integrally formed.

BRIEF DESCRIPTION OF THE DRAWING

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
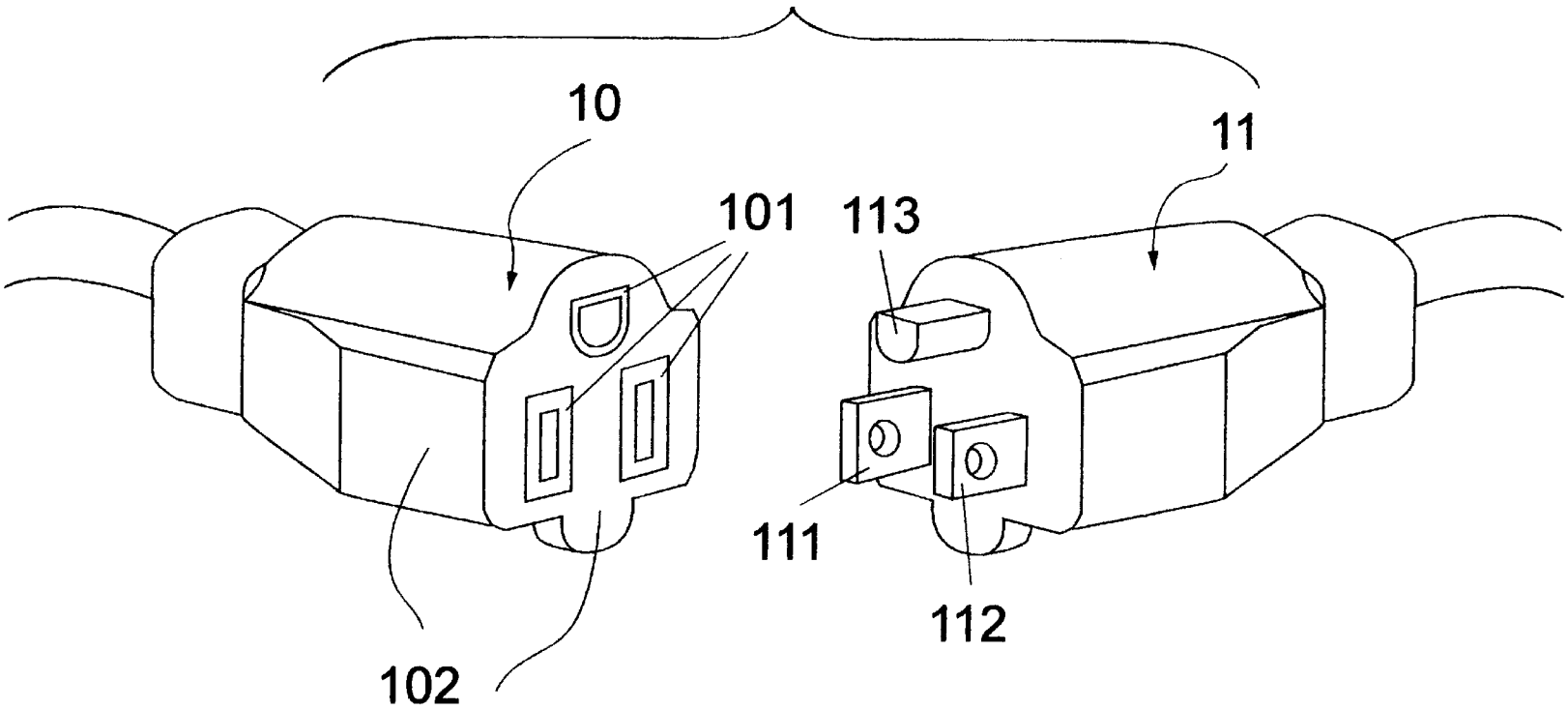
Fig.1(PRIOR ART)
FIG. 1 is a perspective diagram schematically showing the appearance of a power supply receptacle for inserting therein a power plug.
Figure 2:
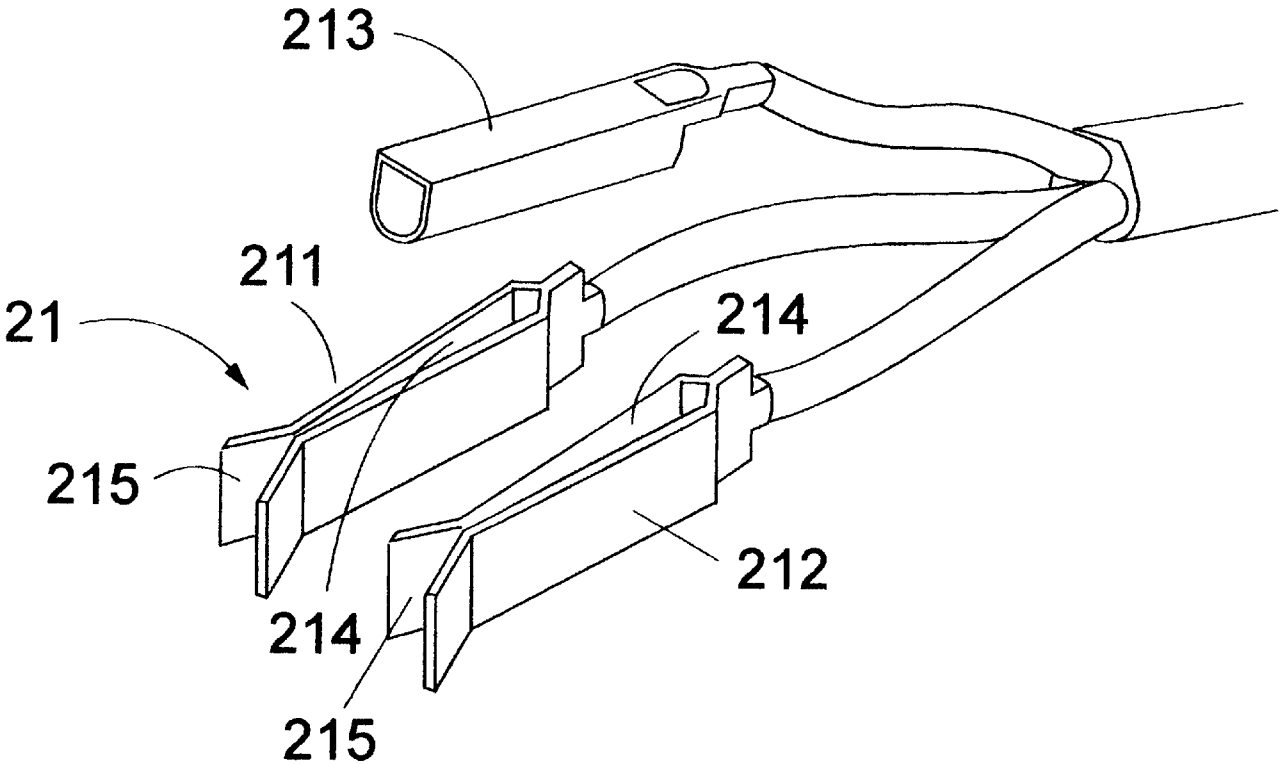
Fig.2(PRIOR ART)
FIG. 2 is a top plan view of a conductive terminal portion of a conventional composite receptacle adapted to be used outdoors.
Figure 3:
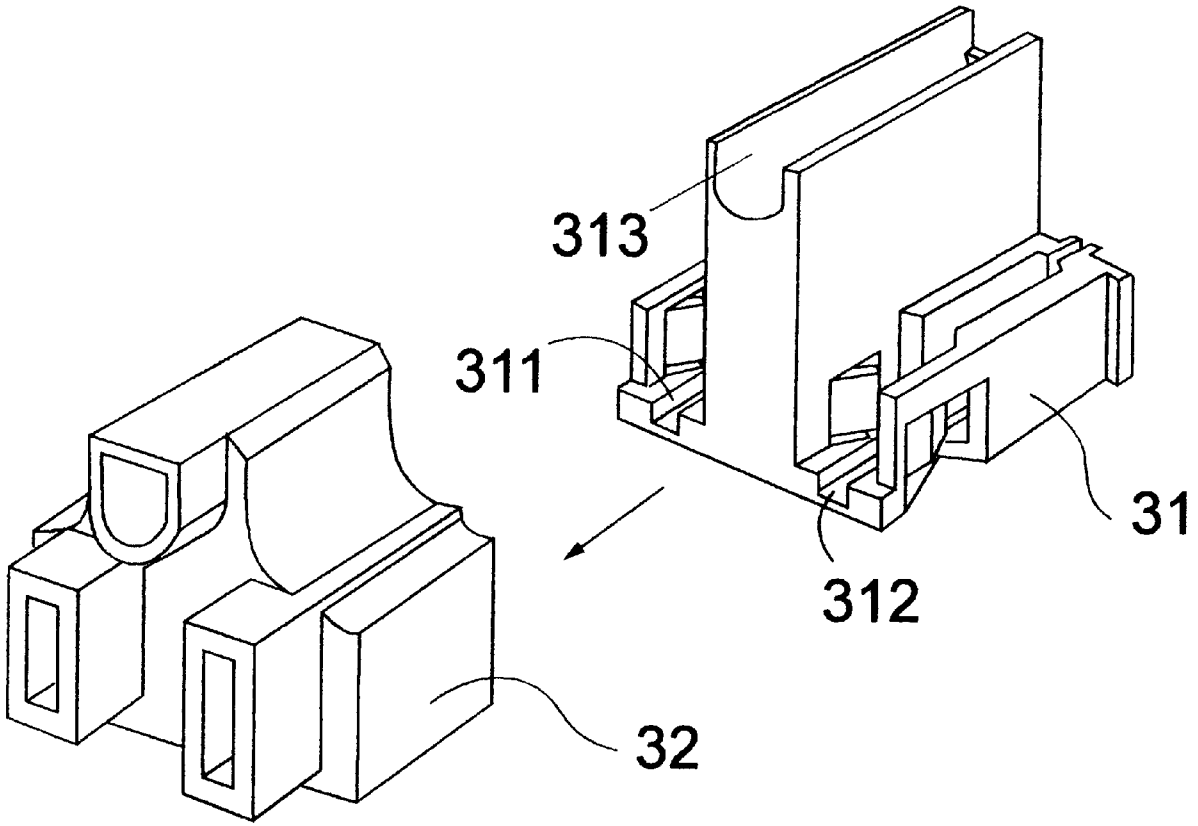
Fig.3(PRIOR ART)
FIG. 3 is a resolving diagram schematically showing a socket portion of the conventional composite receptacle having the conductive terminal portion of FIG. 2.

For the embodiments described as follows, receptacle-type electrical connectors are illustrated, but should not be limited thereto. Herein, an electrical connector according to the present invention is used with a general three-pin electrical plug 11 as shown in FIG. 1. Two of the three pins of the electrical plug are metal pins 111 of a flat plate shape, and the other one is a ground pin 112 of a pillar shape which is optionally included in an electrical plug. It is understood that the electrical connector can be modified according to the present invention to comply with the change of the plug structure, if any.

Figure 4:
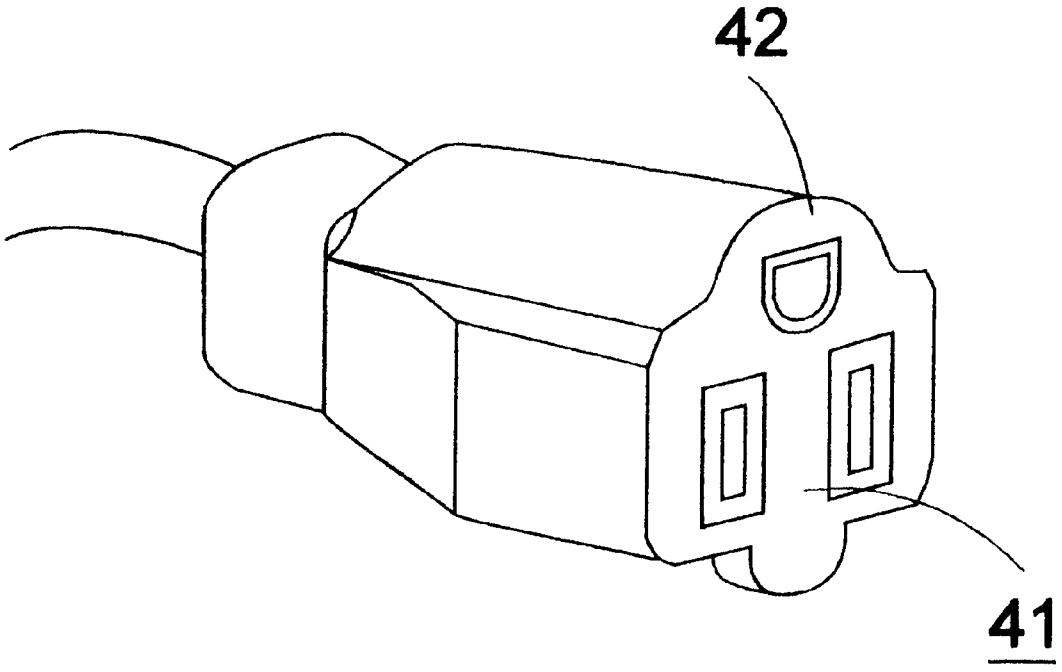
FIG. 4 is a schematic diagram of a preferred embodiment of an electrical connector according to the present invention.

The appearance of an assembled electrical connector according to the present invention is schematically shown in FIG. 4. The reference numeral 41 indicates a socket portion for receiving metal pins 111, 112 and 113 of an electrical plug 11 (FIG. 1) from a front surface 411 thereof, and the reference numeral 42 indicates a wrapping portion enclosing the socket portion 41 but leaving the front portion 411 exposed. In addition to the socket portion and the wrapping portion, the electrical connector further includes conductive terminals positioned in the socket portion for respectively clamping the metal pins of the electrical plug to make electric connection therebetween. As for the unseen inner structure of the socket portion 41 and the details of the conductive terminals covered by the socket portion 41 and the wrapping portion 42, they will be described hereinafter with reference to other figures.

Figure 5:
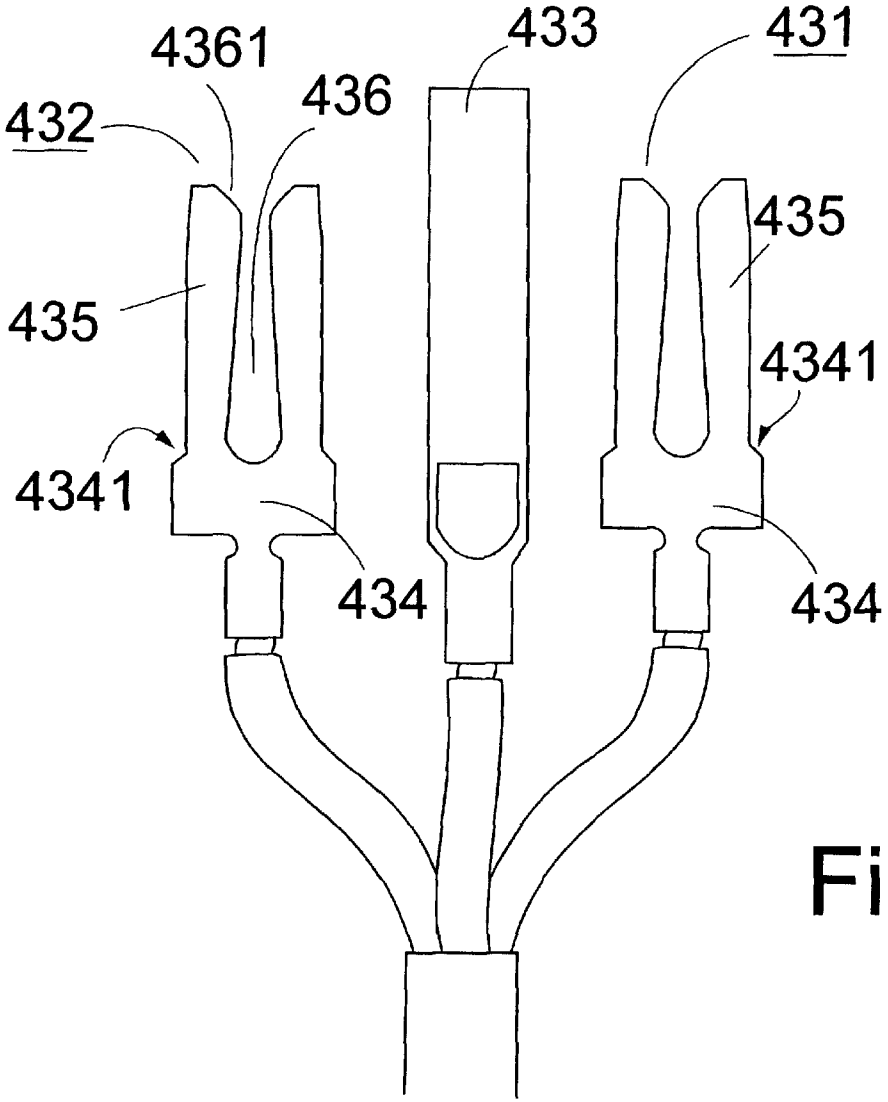
FIG. 5 is a schematic diagram of a preferred embodiment of conductive terminals according to the present invention.

Please refer to FIG. 5 which is a perspective view of a preferred embodiment of conductive terminals according to the present invention. The conductive terminals 43 are mounted in the socket portion 41, and include two flat metal plates 431, 432 and one metal sleeve 433. Each of the two flat metal plates 431 and 432 has a shape relatively narrow in front and relatively wide in rear, and is consisted of a base 434 and two elastic conductive pieces 435. There is a passage 436 between the two elastic conductive pieces 435. The front end of the passage 436 is designed as a funnel-shaped opening 4361. The metal sleeve 433 has a shape similar to the ground pin 113 of the plug 11, but has a size slightly larger than the ground pin 113. The base 434 includes a shoulder structure 4341 so that the width of the base 434 is larger than the total width of the two elastic conductive pieces 435. When the plug 11 is inserted into the socket portion 41, the flat metal pins 111 and 112 are guided by the funnel-shaped openings 4361 into the passages 436 to cross the two flat conductive terminals 431 and 432, respectively, and the ground pin 113 enters the sleeve conductive terminal 433. By this way, the metal pins 111, 112 and 113 are in electric contact with the conductive terminals 431, 432 and 433, respectively, in the socket portion 41.

Figure 6A:
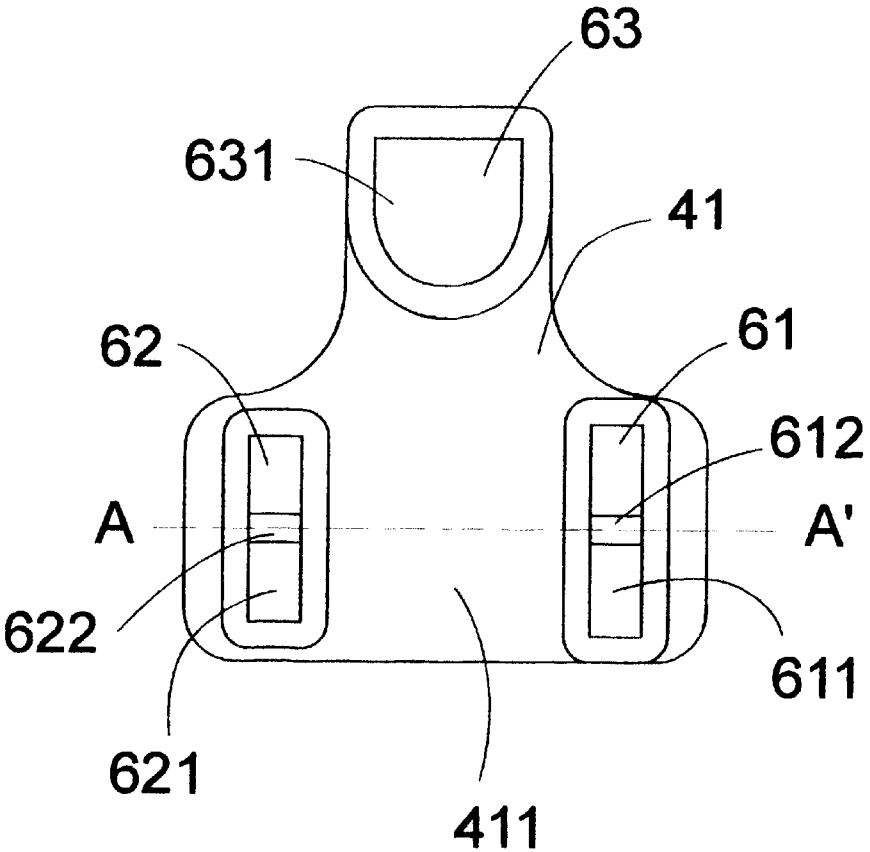
FIG. 6A is a front view of the socket portion of FIG. 4.
Figure 6B:
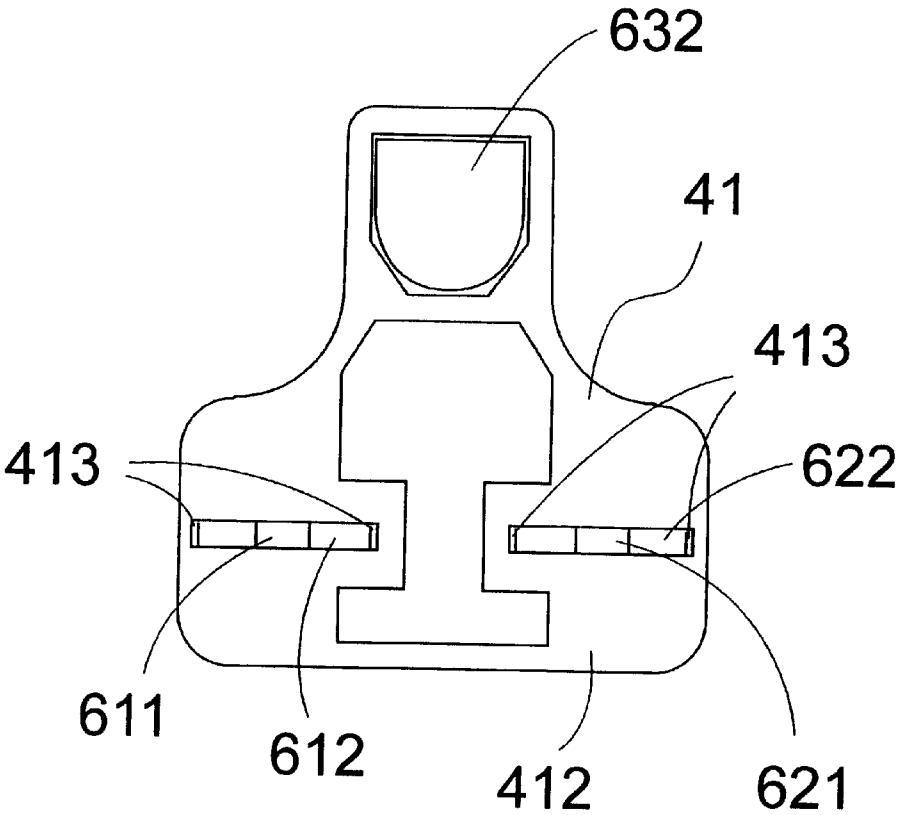
FIG. 6B a rear view of the socket portion of FIG. 4.

The inner structure of a preferred embodiment of the socket portion and the assembling manner of the electrical connector will now be described with reference to FIGS. 6A and 6B. As shown in the figures, the socket portion 41 has three through holes 61, 62 and 63 for respectively receiving the three metal pins 111, 112 and 113 of the plug 11. The three through holes 61, 62 and 63 have respective openings 611, 621 and 631 on the front surface 411 of the socket portion 41 for being inserted therefrom the three metal pins of the plug so that the openings 611, 621 and 631 are designed to be two slot openings 611 and 621 and one shield-shaped opening 631 for matching the shapes of the metal pins 111, 112 and 113. On the other hand, the three through holes 61, 62 and 63 also have respective openings 612, 622 and 632 on the rear surface 412 of the socket portion 41 for being inserted therefrom the conductive terminals 431, 432 and 433, and the openings 612, 622 and 632 are also designed to be two slot openings 612 and 622 and one shield-shaped opening 632 for matching the shapes of the conductive terminals 431, 432 and 433. The directions of the slot openings respectively on the front and the rear surfaces 411 and 412, however, are perpendicular to each other in order to accomplish the crossing engagement of the flat metal pins and the flat conductive terminals as mentioned above.

When assembling the electrical connector, the elastic conductive pieces 435 lead the conductive terminals 431 and 432 to enter the through holes 61 and 62 from the openings 612 and 622 on the rear surface 412 of the socket portion 41, and the sleeve conductive terminal 433 is inserted into the through hole 63 from the opening 632. Afterwards, the wrapping portion 42 is injection molded onto the socket portion 41 to secure and protect the inserted conductive terminals 431, 432 and 433 in the socket portion 41.

Figure 6C:
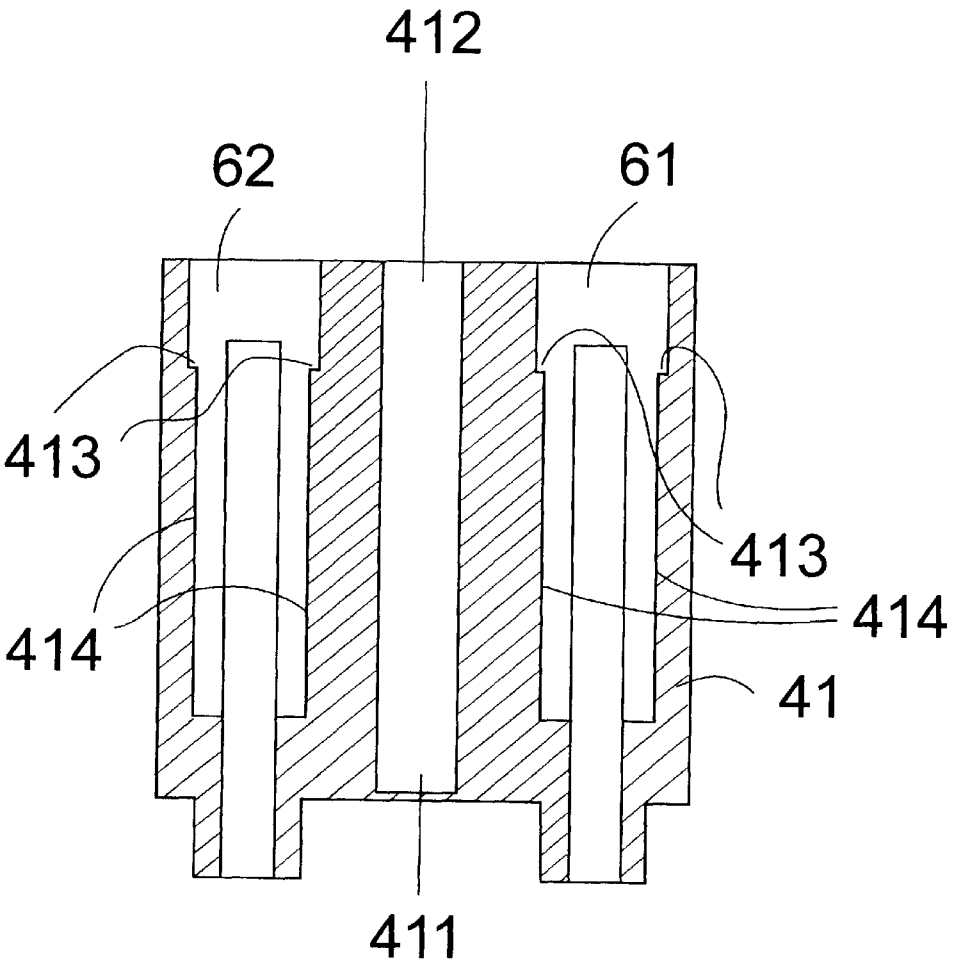
FIG. 6C is a cross-sectional taken along a line A–A' of FIG. 6.

In order not to give any chance to the material constituting the wrapping portion to enter the through holes during the injection molding process, it is required that the bases 434 of the conductive terminals 431 and 432, each of which has a total width larger than the total width of the two elastic conductive pieces parallelly connected therewith, fill the openings 612 and 622 after the elastic conductive pieces 435 enter the through holes 61 and 62. On the other hand, the shoulder structure 4341 of the base 434 sustains against a stopper structure 413 (FIG. 6C) arranged in each of the through holes 61 and 62 in order to prevent the base 434 from entirely entering the through hole, and thus assure that the base 434 can fill the opening 612 or 622. In addition, the most important function of the shoulder structure 4341 is to make the total width of the elastic conductive pieces 435 less than the width of the base 434 so as to assure of a gap between the elastic conductive pieces 435 and walls 414 of the through hole 61 or 62 after the elastic conductive pieces 435 enter the through hole 61 or 62. The presence of the gap provides a stretching space for the conductive pieces once a thermally expansion effect occurs.

For being used outdoors, the socket portion of the electrical connector according to the present invention is preferably made of an insulating material having a relatively low temperature sensitivity which is more preferably lower than that of the insulating material constituting the wrapping portion. The insulating material for forming the socket portion can be an engineering plastic such as an Acrylic-Butadiene-Styrene (ABS), polycarbonate, nylon-glass fiber composite, polyethylene (PE) or polypropylene (PP). On the other hand, the insulating material for forming the wrapping portion can be polyvinyl chloride (PVC) which is suitable for an injection molding process. As for the material of the conductive terminals, brass or phosphorous bronze can be used.

From the above illustration, it is clear that the electrical connector can be easily assembled by simply inserting the conductive terminals into the socket portion and then applying the wrapping portion.

Figure 7:
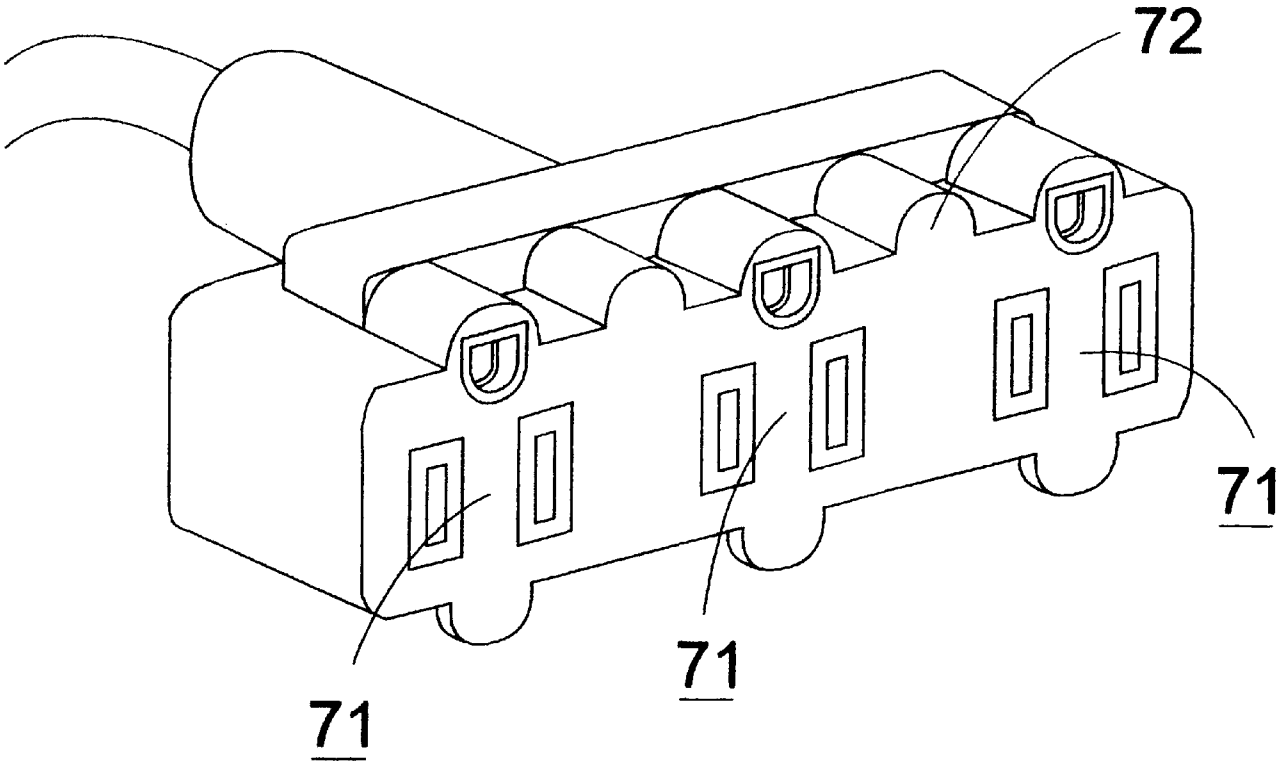
FIG. 7 is a schematic diagram of another embodiment of an electrical connector according to the present invention.

Moreover, a plurality of socket portions 71 can be parallelly connected to form a multi-socket electrical connector, as shown in FIG. 7, by applying common wrapping portion 72 onto the parallelly aligned socket portions.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical connector for receiving therein a metal pin of an electrical plug to make an electric connection, comprising:

a socket portion integrally formed of a first insulating material, said socket portion having a first surface at a front of said socket portion, a second surface at a back of said socket portion, and a first through hole extending from a first opening in said first surface to a second opening in said second surface, wherein a shape of said first opening matches a shape of said metal pin of said electrical plug to allow said metal pin to be inserted through said first opening into said first through hole; and a first conductive terminal consisting of a first base and two first elastic conductive pieces, said first base and first elastic conductive pieces being directly inserted through said second opening into said first through hole, said first elastic pieces being arranged to receive and clamp said metal pin of said electrical plug when said metal pin is inserted into said first through hole through said first opening into a passage between said two first elastic conductive pieces, wherein a shape of said second opening matches a shape of said first conductive terminal, and said two first elastic conductive pieces are connected to said first base, extend parallel to each other in a first direction, and have a total width in a second direction transverse to said first direction, said total width including a width of said passage, that is narrower than a width of said first base in said second direction, said first base being arranged to fill said second opening after said two first elastic conductive pieces have been inserted into said first through hole, wherein said first and said second openings are two slots perpendicular to each other, and said metal pin and said first conductive terminal are two flat metal plates inserted from said first and said second openings, respectively, and cross each other in said first through hole; and further comprising a wrapping portion made of a second insulating material applied onto said socket portion for securing and protecting said first conductive terminal in said socket portion.

2. The electrical connector according to claim 1 wherein said first base has a shoulder structure protruding from sides of said first elastic conductive pieces so as to have a width larger than a total width of said first elastic conductive pieces, and said shoulder structure assures of a gap between said first elastic conductive pieces and walls of said first through hole after said first elastic conductive pieces enter said first through hole.

3. The electrical connector according to claim 2 wherein a stopper structure is arranged in said first through hole to sustain against said shoulder structure of said first conductive terminal.

4. The electrical connector according to claim 1 wherein said socket portion further includes a second through hole penetrating therethrough, wherein a third and a fourth openings of said second through hole are located on said first and said second surfaces of said socket portion, respectively, and a shape of said third opening matches a shape of another metal pin of said electrical plug to allow said another metal pin to be inserted therefrom.

5. The electrical connector according to claim 4 further comprising a second conductive terminal consisting of a second base and two second elastic conductive pieces and inserted into said second through hole from said fourth opening for clamping said another metal pin inserted from said third opening in a passage between said second two elastic conductive pieces, wherein said second two elastic conductive pieces are parallelly connected to said second base and have a total width narrower than a width of said second base so that said second base fills said fourth opening after said two second elastic conductive pieces enter said second through hole.

6. The electrical connector according to claim 6 wherein said socket portion further includes a third through hole penetrating therethrough for optionally receiving therein a ground pin of said electrical plug which is in electric contact with a third conductive terminal in said third through hole.

7. The electrical connector according to claim 6 wherein said third through hole has an opening shape on said first surface of said socket portion matching a shape of said ground pin of said electrical plug to allow said ground pin to be inserted therefrom.

8. The electrical connector according to claim 5 wherein said wrapping portion is applied onto said socket portion for securing and protecting said first and said second conductive terminals in said socket portion.

9. The electrical connector according to claim 8 wherein said second conductive terminal has a shape substantially the same as that of said first conductive terminal.

10. The electrical connector according to claim 9 wherein said first and said second openings are two slots perpendicular to each other, and said third and said fourth openings are another two slots perpendicular to each other.

11. The electrical connector according to claim 1 wherein a front end of said passage between said two first elastic conductive pieces is of a funnel shape for guiding said metal pin into said passage smoothly.

12. The electrical connector according to claim 1 wherein said wrapping portion is applied onto said socket portion by injection molding said second insulating material onto said socket portion with said first conductive terminal.

13. The electrical connector according to claim 1 wherein said first insulating material has lower temperature sensitivity than said second insulating material.

14. The electrical connector according to claim 13 wherein said first insulating material is an engineering plastic.

15. The electrical connector according to claim 14 wherein said first insulating material is one selected from a group consisting of Acrylic-Butadiene-Styrene (ABS), polycarbonates, nylon-glass fiber composites, polyethylene (PE) and polypropylene (PP).

16. The electrical connector according to claim 13 wherein said second insulating material is polyvinyl chloride (PVC).

17. The electrical connector according to claim 1 being a receptacle adapted to be used outdoors.

* * * * *